United States Patent [19]

Schnyder

[11] 4,009,837

[45] Mar. 1, 1977

[54] WOOD CHIPPING APPARATUS

[76] Inventor: Auxilius P. Schnyder, 146 Cherry Lane, Teaneck, N.J. 07666

[22] Filed: Nov. 20, 1975

[21] Appl. No.: 633,857

Related U.S. Application Data

[63] Continuation-in-part of Ser. No. 535,727, Dec. 23, 1974, abandoned, which is a continuation of Ser. No. 404,134, Oct. 9, 1973, abandoned.

[52] U.S. Cl. ..... 241/93; 144/163; 144/172; 144/230; 144/326 A; 241/152 A; 241/294

[51] Int. Cl.[2] ..... B02C 18/18; B02C 18/22

[58] Field of Search ..... 241/93, 152 A, 222–224, 241/280, 282.1, 282.2, 293, 294; 144/163, 172, 175, 230, 326 R, 326 A, 326 B, 326 C, 326 D

[56] References Cited

UNITED STATES PATENTS

| | | | |
|---|---|---|---|
| 970,864 | 9/1910 | Washburn | 241/93 |
| 1,099,966 | 6/1914 | Choate | 241/282.1 |
| 2,010,765 | 8/1935 | Kendrek | 241/93 X |
| 2,596,604 | 5/1952 | Schaeffer | 241/280 |
| 3,526,259 | 9/1970 | Lapointe | 241/93 X |
| 3,635,410 | 1/1972 | Smith | 144/176 X |
| 3,661,192 | 5/1972 | Nicholson et al. | 241/93 X |
| 3,913,643 | 10/1975 | Lambert | 144/326 A X |

*Primary Examiner*—Roy Lake
*Assistant Examiner*—Howard N. Goldberg
*Attorney, Agent, or Firm*—Pennie & Edmonds

[57] ABSTRACT

Wood chipping apparatus including a removable wood chipping cartridge in the form of a hollow drum having axial extending wood chipping knives positioned adjacent to wood chip receiving apertures in the drum. The drum is removably connected, at one end, to the end of a drive shaft, whereby the drum is supported in a cantilever fashion. For knife sharpening, the entire cartridge is removed and replaced with a cartridge having sharpened knives.

13 Claims, 6 Drawing Figures

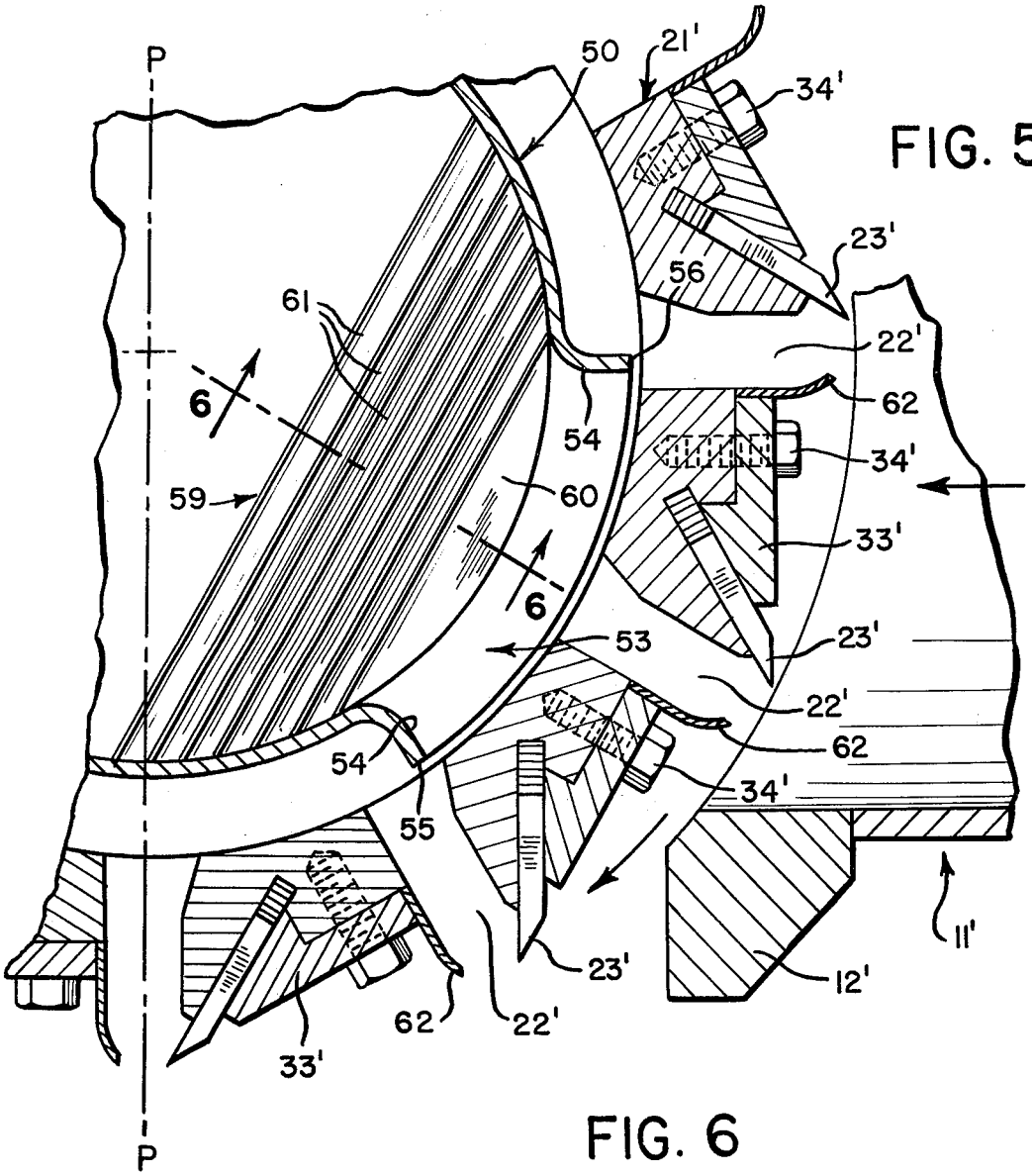
FIG. 5
FIG. 6
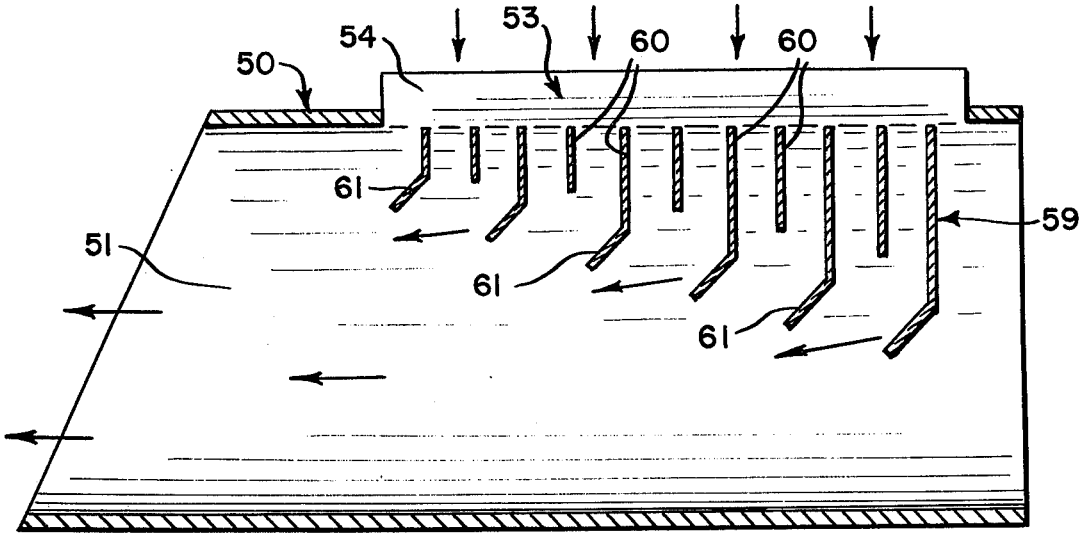

WOOD CHIPPING APPARATUS

RELATED APPLICATIONS

This application is a continuation-in-part of my copending application Ser. No. 535,727, filed Dec. 23, 1974, now abandoned, which is, in turn, a continuation of my application Ser. No. 404,134 filed Oct. 9, 1973, now abandoned.

BACKGROUND OF THE INVENTION

This invention relates to the production of wood chips, and more particularly to a new and improved cutter for producing wood chips.

In general, the cutting apparatus employed for producing wood chips are of the rotating disc type having a plurality of cutting blades mounted on a work face thereof. Logs or other large pieces of wood are fed to the working face of the rotating disc and the shearing action of the blades causes chips to be severed from the logs and pass through slots in the disc adjacent to the cutting blades. After a certain working period of operation, the knives require sharpening and in the cutting apparatus currently available in the art, the machine is taken out of operation and each of the knives is removed from the disc and replaced with sharpened knives. The machine "down time" for replacing the knives reduces the overall capacity of the apparatus.

SUMMARY OF THE INVENTION

Generally, the apparatus of the present invention includes a cutting drum which is supported at one end in a cantilever fashion. The cutting drum includes a plurality of circumferentially spaced and axially extending wood chipping knives on its periphery. Axially extending wood chip receiving apertures are formed adjacent each knife. The end of the drum which is mounted in cantilever fashion is closed to provide a face plate which is adapted to be bolted to the flanged free end of a drive shaft. The other end of the drum is open for permitting wood chips to exit from the interior of the drum.

In a preferred construction of the apparatus, a second drum is provided. This second drum which is open ended and shaped complementary to the shape of the first drum, is supported in cantilever fashion within the first drum with its open end extending out the open end of the outer drum. This second drum has a single axially extending wood chip receiving aperture for receiving wood from all the apertures of the first drum. The single aperture is located in alignment with a log feeding structure by which logs are fed to the knives of the outer rotating drum. The second drum is provided with a plurality of knives mounted interiorly of the single aperture and in the path of movement of the chips entering the aperture. These knives break the entering chips into smaller sizes. Deflectors are also provided at the single aperture of the second drum for deflecting the cut chips out the open end of the drum.

An object of the present invention is to provide a new and improved cutting apparatus for producing wood chips in which "down time" is minimized.

BRIEF DESCRIPTION OF THE DRAWINGS

FIG. 5 is a partial sectional view of the cutting drum of the embodiment shown in FIG. 3; and FIG. 6 is a cross-sectional view taken along lines 6—6 of FIG. 5.

DETAILED DESCRIPTION OF THE PREFERRED EMBODIMENTS

In accordance with the present invention, there is provided a cutting apparatus for producing chips comprised of a hollow drum having a plurality of wood chipping knives arranged in a plurality of circumferentially spaced axial extending rows around the outer peripheral surface of the drum. A series of circumferentially spaced axial extending apertures or slots are formed in the outer periphery of the drum adjacent to the chipper blades; and chips, which are severed from a log or large piece of wood fed to the rotating peripheral surface of the drum by the shearing action of the rotating blades, pass through the slots into the interior of the drum. The drum includes support means on one end thereof for removably supporting and drivingly connecting the drum, in a cantilever fashion, to the end of a drive shaft for rotating the drum. In this manner, the entire drum may be removed from the drive shaft and replaced with a drum having sharpened knives, thereby eliminating the necessity for taking the machine out of operation over the period required to remove and replace the cutting blades.

The invention will be further described with respect to specific embodiments thereof illustrated in the accompanying drawing, but it is to be understood that the scope of the invention is not to be limited thereby.

Figure 1:
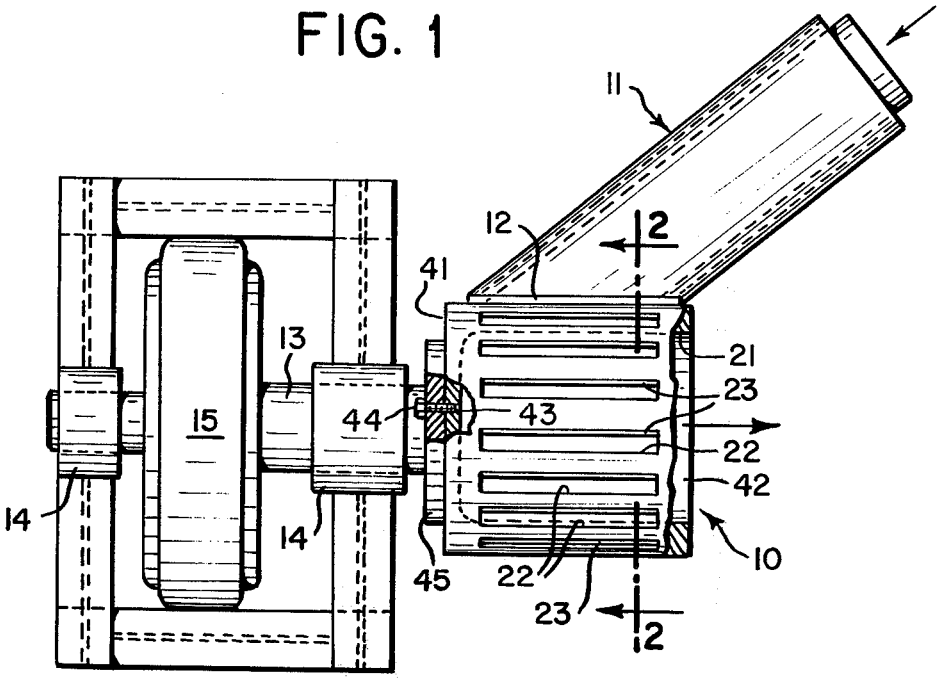
FIG. 1 is a top plan view, partially broken away, of an embodiment of the chip cutting apparatus of the present invention.
Figure 2:
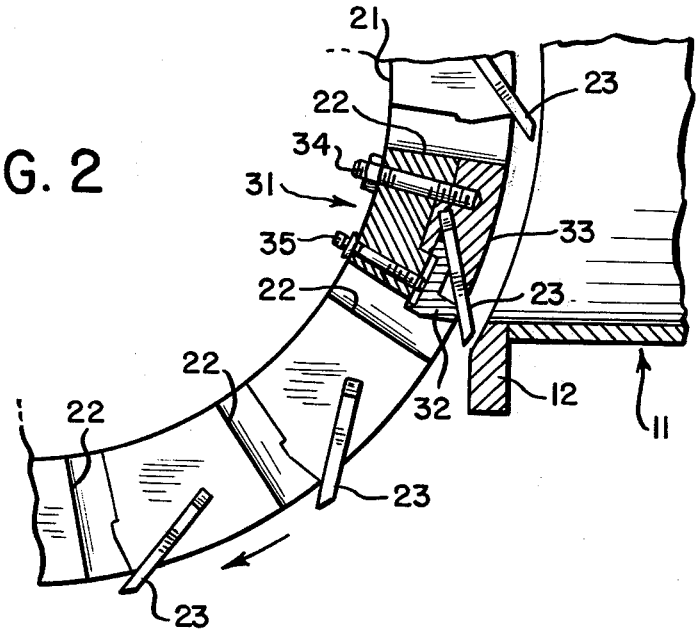
FIG. 2 is a partial section along line 2—2 of FIG. 1, including a detail of the bed knife.
Figure 3:
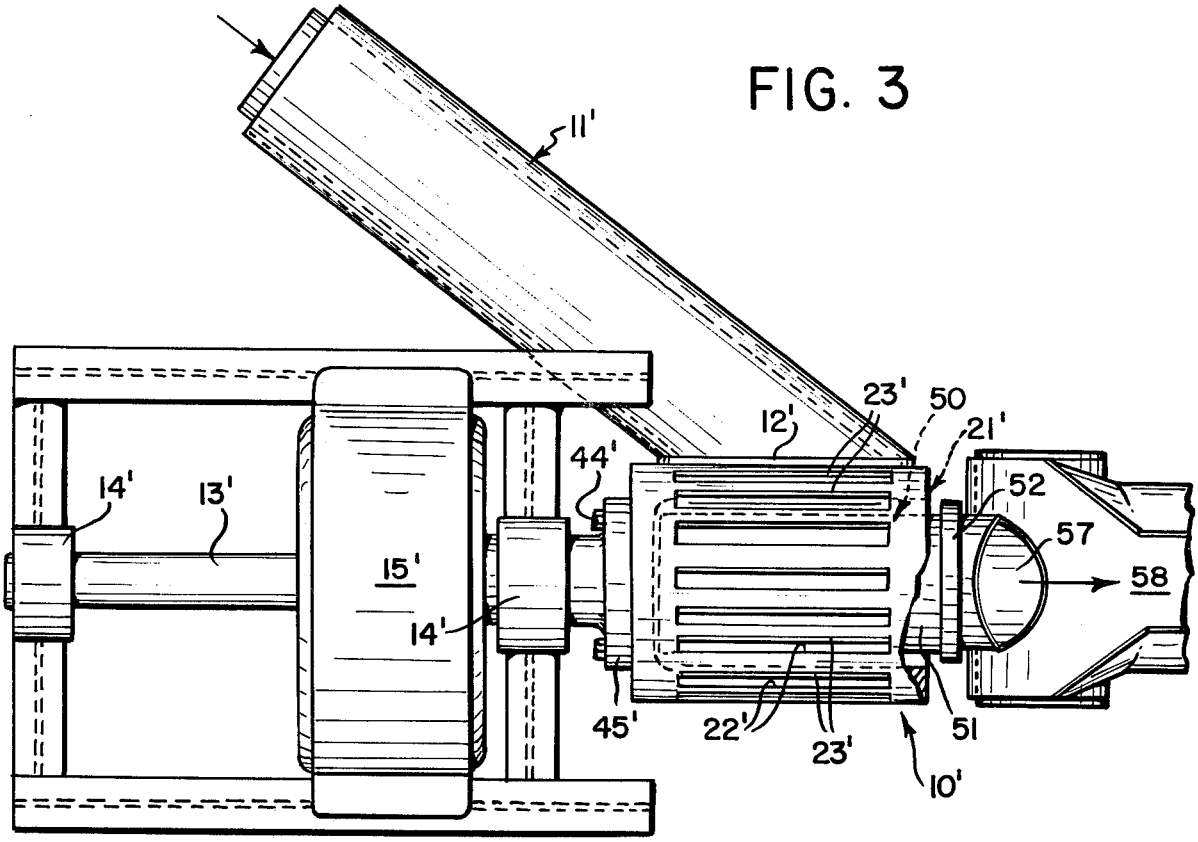
FIG. 3 is a plan view of a modified embodiment of the chip cutting apparatus of the present invention.

Referring to the drawings, there is illustrated in FIGS. 1 and 2 a high speed chipping apparatus comprised of wood chipping cartridge 10; a log feeding means in the form of a sideward horizontal log feeding spout 11, including an anvil 12, and suitable means (not shown), such as rollers, for advancing logs into cutting position, the spout being angularly positioned with respect to the peripheral working surface of the chipping cartridge 10; a main drive shaft 13; means for rotatably supporting the shaft 13 in a cantilever fashion in the form of bearings 14; and a drive means, such as a motor, schematically indicated at 15. The log feed spout 11 and anvil 12 form a separate structure which is supported independently of the wood chipping cartridge. Accordingly, clearance between the chipper knives and outlet of spout 11 can be adjusted. If required, the chipping cartridge 10 may be counterbalanced by a counterweight (not shown) on the opposite end of shaft 13.

The wood chipping cartridge 10 is comprised of a hollow drum 21 having a closed end, defined by an end plate 41, and an opposite open chip discharging end 42. The peripheral surface of drum 21 includes chip receiving slots defined by a plurality of parallel axial extending circumferentially spaced slots or apertures 22 for receiving chips sheared from a log by a plurality of parallel axial extending circumferentially spaced wood chipping knives 23. The knives 23 extend along the length of the drum with the cutting edges thereof extending radially outwardly beyond the peripheral surface of the drum 21 over the apertures 22, whereby chips sheared from a log in spout 11 pass through the apertures 22 into the interior of drum 21. In a particular preferred embodiment, shown in FIGS. 1 and 2, the drum is provided with 15 parallel knives equally spaced over the drum periphery.

The knives 23 are removably fastened to the drum 21 by a clamping assembly, generally indicated as 31, and are supported at an angle in the direction of rotation of drum 21. The clamping assembly 31 is comprised of a C-shaped clamp 32 and a segmental knife holder 33 which is secured to the drum 21 by studs 34. The knives 23 are secured between the clamp 32 and knife holder 33 by pressure applied by clamping bolts 35.

The closed end of the drum 21 is provided with means for drivingly securing the drum to the end of the drive shaft, in a cantilever fashion, in the form of a plurality of spaced bores 43 circularly arranged on end plate 41. The bores 43 receive fastening means, in the form of bolts 44, which removably secure the drum 21 through corresponding bores in a shaft flange 45 on the end of drive shaft 13. In this manner, the drum 21 is supported, in cantilever fashion, on the free end of drive shaft 13, with the peripheral cutting surface positioned in cutting position with respect to logs in spout 11.

The interior of drum 21 may be further provided, as known in the art, with suitable means for feeding chips in the drum interior toward the discharge end 42 thereof, such as spiral ribs (not shown) and/or "card breaker" blades.

In operation, the drum 21 is rotated by drive means 15 through main drive shaft 13 and the rotating chipping knives 23 make angular cuts into logs positioned in spout 11 to produce chips which enter the interior of the drum 21 through apertures 22. The chips are discharged from the interior of the drum 21 through the open end 42 thereof.

After a certain operating period, the knives require resharpening, and at that time, the entire cartridge 10 is removed from the drive shaft 13 by unfastening the bolts 44, and another cartridge, having sharpened knives, is then connected to the drive shaft. In this manner, the "down time" of the apparatus is minimized in that the cutting knives are not removed and replaced with sharpened knives, as in prior art devices, during machine "down time." For example, machine "down time" can be reduced from some 45 minutes to under five minutes. Accordingly, the overall capacity of the cutting machine is increased. In addition, as a result of the circular travel of the knives, standard flat knives can be used.

FIGS. 3–6 show a modified embodiment of the present invention. This modified embodiment is constructed in general accordance with the embodiment of FIGS. 1 and 2. It differs in that it includes a second drum 50, a modified log feeding means and a modified knife clamping structure. As far as the structural details which are the same as shown in FIGS. 1 and 2, the same reference numerals with the suffix prime (′) are used in FIGS. 3–6.

In construction, the wood chipping cartridge 10′, including the hollow drum 21′ is mounted in cantilever fashion to the flanged free end 45′ of the drive shaft of the drive motor 15′. In addition to the hollow drum 21′, a second stationary drum 50 is provided. This drum is shaped complementary to the hollow drum and positioned in spaced relationship within it. The positioning of the second drum within the first drum is with the longitudinal axes of the two drums coincident.

Figure 4:
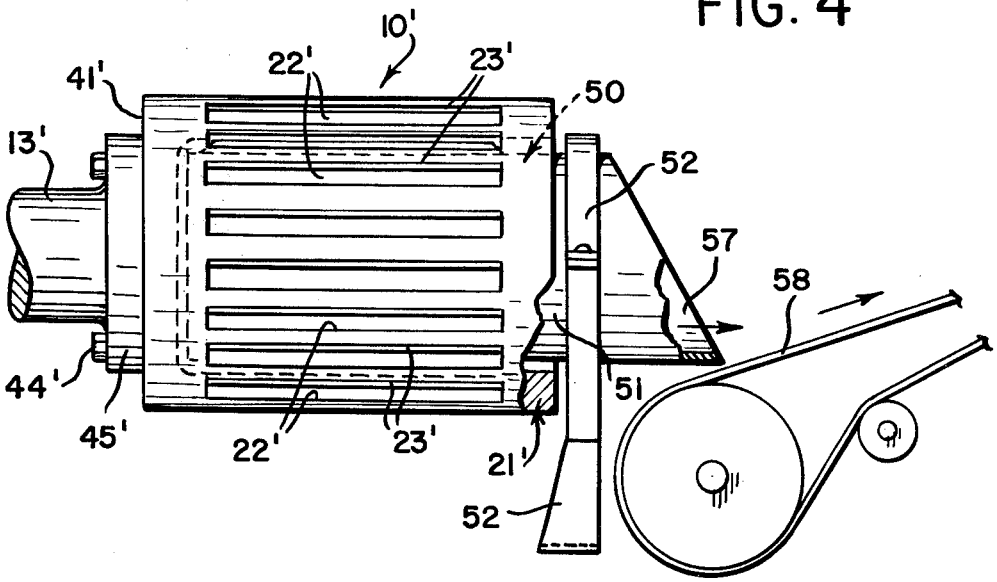
FIG. 4 is a side view of the modified embodiment shown in FIG. 3.

The inner stationary drum 50 has an open end 51 which extends out the open end 42 of the outer rotating drum. A support post 52 is attached to the open end of the drum 50 for mounting it in cantilever fashion. As shown in FIG. 4, the support post is positioned beyond the open end of the first drum.

In constrast to the plurality of wood chip receiving apertures of the outer rotating drum, the inner stationary drum includes a single wood chip receiving aperture. This aperture, which is shown most clearly in FIG. 5 at 53, is defined by an opening 54 in the cylindrical wall of the second drum. More particularly, the wall of this drum does not form a completely closed cylinder. Instead, the ends of the walls as formed at 55 and 56 are directed radially outwardly for the entire axial length of the opening to define the aperture 53.

As shown in FIG. 5, this aperture 53 is positioned at an angle of about 45° from the vertical plane P-P extending through the longitudinal axis of the drum. At this same position, the log feeding chute 11′ is horizontally disposed for feeding logs into cutting relation with the wood chipping knives 23′ of the outer rotating drum as these knives move past the aperture 53. Besides being aligned with the log feeding chute 11′, the single wood chip receiving aperture 53 of the inner drum has a circumferential width, as measured circumferentially between the end walls 55 and 56, which is at least equal to the diameter of the chute and logs being fed through the chute. This assures that the wood being chipped from the logs through the entire cutting engagement of the knives therewith will have access not only to the apertures 22′ of the outer drum but in addition, will have access to the interior of the inner stationary drum through the single aperture 53.

In the embodiment shown in FIGS. 3–6, the log feeding chute includes wall structure which guides the logs axially into cutting engagement with the knives 23′ of the outer drum. In a way similar to the construction of FIGS. 1 and 2, the log feeding chute 11′ is supported separately from the first and second drums and disposed at an acute angle with respect to the longitudinal axes of these drums. As distinguished from the embodiment of FIGS 1 and 2, however, the chute 11′ is mounted in a direction to feed the logs toward the open ends of the drums. Thus, as the chips enter the interior of the drums, they have a component of movement which is in the direction of discharge from the drums.

As shown in FIG. 4, the inner drum 50 includes a discharge chute 57 extending axially beyond its open end and through which wood chips are discharged from its interior. Associated with this discharge chute is a discharge conveyor 58. This conveyor is positioned in underlying alignment with the chute 57 for conveying discharged wood chips away from the drums and to the next processing operation.

In many prior art types of wood chipping structures, the wood chips must be broken by separate apparatus before being discharged from the chipper apparatus. In accordance with the teachings of the present invention, the chips originally cut from the incoming logs are reduced in size as they enter the interior or the stationary drum. For this purpose, knife means in the form of a plurality of thin plates 59 are positioned in the wood chip receiving aperture 53. As shown in FIG. 6, these plates extend transversely of the width of the aperture 53 and in spaced relation along its entire axial length.

Each plate includes a cutting section 60 disposed perpendicularly across the chip receiving aperture 53 so that as the chips of wood enter the aperture, they will strike against these cutting sections and be broken into smaller pieces. This breaking will be possible due to the fact that the grain of the wood chips runs perpendicular to the cut surfaces. Thus, the chips have little strength across their face and are easily broken into smaller pieces.

To direct the chips of wood toward the open end 51 of the drum 50, every other plate includes a deflector section 61 disposed radially inwardly of each knife section. The deflector sections are angled at about 45° toward the open end 51 of the drum and extend axially into alignment with each next adjacent plate that does not include a deflector section. Also, as shown in FIG. 6, each deflector plate extends radially inwardly of the drum 50 by a different distance than the next adjacent plate. In particular, the plate furthest from the open end 51 of the drum extends furthest into the drum while the plate nearest the open end extends the least distance into the drum. In this way, the wood chips are more readily deflected toward the open end without interfering with each other.

A further distinction between the embodiment shown in FIGS. 3–6 and that of FIGS. 1 and 2 is a clamping construction for the knives 23'. As shown most clearly in FIG. 5, the knives 23' are individually clamped by clamping means 33' and associated bolt structure 34'; and all of this mechanism is mounted exteriorly of the drum. In this way, access to the clamps for removal of the individual knives is facilitated. In addition, each clamp 33' has at its rearward end a radially extending guide 62. The guide of each clamp is adapted to be associated with the knife 23' disposed rearwardly of the guide. These guides extend in a curved direction toward the associated knife but in a radial direction which is less than the radial extent of the knife. The wood chips being cut from the log by each knife are therefore directed by the guide 62 into the associated aperture 22' of the outer drum.

What is claimed is:

1. A high speed wood chipping apparatus comprising:

a. a first drum having:
   1. a closed end,
   2. an open end, and
   3. a plurality of circumferentially spaced wood chip receiving apertures in the peripheral surface of the drum for passing wood chips into the drum interior;

b. a plurality of circumferentially spaced wood chipping knives mounted on the drum adjacent to said apertures;

c. means for rotating the drum;

d. a second drum having:
   1. an open end, and
   2. shaped complementary to the shape of the first drum for positioning therein with its open end facing out the open end of the first drum;

e. means for supporting said second drum positioned within said first drum;

f. a wood chip receiving aperture in the peripheral surface of the second drum for passing wood chips received from all of the apertures of the first drum into the interior of the second drum; and g. log feeding means for feeding logs in a cutting relation to the wood chipping knives on the first drum where they move past the wood chip receiving aperture of the second drum.

2. A high speed wood chipping apparatus comprising:

a. a first drum having:
   1. a closed end,
   2. an open end, and
   3. a plurality of circumferentially spaced axially extending wood chip receiving apertures in the peripheral surface of the drum for passing wood chips into the drum interior;

b. a plurality of circumferentially spaced axially extending wood chipping knives mounted on the drum adjacent to said apertures, said knives having cutting edges extending beyond the periphery of the drum;

c. means for rotating the drum including a drive shaft having a flanged free end;

d. means for removably attaching the flanged free end of the drive shaft to the closed end of the drum whereby the drum is supported at the closed end in a cantilever fashion;

e. a second drum having:
   1. an open end, and
   2. shaped complementary to the shape of the first drum for stationary positioning in spaced relation therein with its open end extending out the open end of the first drum;

f. means for supporting said second drum positioned within said first drum;

g. a single axially extending wood chip receiving aperture in the peripheral surface of the second drum for passing wood chips received from all of the apertures of the first drum into the interior of the second drum, said single aperture being located at a predetermined location relative to the vertical plane extending through the longitudinal axis of the second drum; and h. log feeding means for feeding logs in a cutting relation to the wood chipping knives on the first drum where they move through said predetermined location.

3. The wood chipping apparatus of claim 2 wherein:

a. the wood chip receiving aperture of the second drum is disposed at an angle of about 45° with respect to said vertical plane and as measured in a direction opposite the direction of rotation of said first drum.

4. The wood chipping apparatus of claim 3 wherein:

a. said means for supporting the second drum includes a support attached to its open end beyond the open end of the first drum for holding the second drum in cantilever fashion within the first drum.

5. The wood chipping apparatus of claim 4 further comprising:

a. knife means disposed within the wood chip receiving aperture of the second drum in the path of the wood chips for breaking them into smaller pieces.

6. The wood chipping apparatus of claim 5 wherein:

a. said knife means includes a plurality of spaced thin plates having cutting sections disposed perpendicularly across the wood chip receiving aperture.

7. The wood chipping apparatus of claim 6 wherein:

a. the cutting section of the knife means extends across the wood chip receiving aperture at spaced intervals along the entire axial length of the aperture; and b. at least some of the thin plates of the knife means further include deflector sections disposed radially inwardly of the knife section and angled toward the open end of the second drum.

8. The wood chipping apparatus of claim 7 wherein:

a. every other thin plate of the knife means includes a deflector section; and b. each deflector section extends axially of the second drum to deflect wood chips cut by all knife sections toward the open end of the second drum.

9. The wood chipping apparatus of claim 4 wherein:

a. the second drum includes a cylindrical wall having an axially extending opening with the ends of the wall on opposite sides of the opening being directed radially outwardly to define the wood chip receiving aperture.

10. The wood chipping apparatus of claim 9 wherein:

a. the wood chip receiving aperture of the second drum has a circumferential width at least equal to the diameter of the logs being cut; and b. the log feeding means includes guide structure for feeding the logs axially into cutting relation with the wood chipping knives of the first drum.

11. The wood chipping apparatus of claim 10 wherein:

a. the log feeding means is separately supported from the first and second drums and disposed at an acute angle with respect to the longitudinal axes of the drums for feeding logs at said acute angle and in the same direction as the direction of discharge of the wood chips from the interior of the drums.

12. The wood chipping apparatus of claim 4 wherein:

a. the second drum includes a discharge chute extending axially beyond its open end and through which said wood chips are discharged.

13. The wood chipping apparatus of claim 12 further comprising:

a. a chip discharge conveyor positioned in underlying alignment with the discharge chute of the second drum for conveying discharged wood chips away from the first and second drums.

* * * * *